US007660539B2

(12) United States Patent
Tye et al.

(10) Patent No.: US 7,660,539 B2
(45) Date of Patent: Feb. 9, 2010

(54) PRINTER CONSUMABLE ORDERING DIRECT FROM PRINTER

(75) Inventors: Bee June Tye, Singapore (SG); Song Poh Chai, Singapore (SG)

(73) Assignee: Dell Products, L.P., Round Rock, TX (US)

( * ) Notice: Subject to any disclaimer, the term of this patent is extended or adjusted under 35 U.S.C. 154(b) by 286 days.

(21) Appl. No.: 11/775,902

(22) Filed: Jul. 11, 2007

(65) Prior Publication Data

US 2009/0016743 A1 Jan. 15, 2009

(51) Int. Cl.
*G03G 15/00* (2006.01)

(52) U.S. Cl. ..... 399/24

(58) Field of Classification Search ..... 399/8, 399/9, 24, 25, 27, 81
See application file for complete search history.

(56) References Cited

U.S. PATENT DOCUMENTS

| | | | | |
|---|---|---|---|---|
| 4,389,706 | A | 6/1983 | Gomola et al. | 364/130 |
| 4,589,063 | A | 5/1986 | Shah et al. | 364/200 |
| 4,870,591 | A | 9/1989 | Cicciarelli et al. | 364/468 |
| 5,257,387 | A | 10/1993 | Richek et al. | 395/800 |
| 5,305,199 | A | 4/1994 | LoBiondo et al. | 364/403 |
| 5,416,842 | A | 5/1995 | Aziz | 380/30 |
| 5,517,494 | A | 5/1996 | Green | 370/60 |
| 5,526,489 | A | 6/1996 | Nilakantan et al. | 395/200.02 |
| 5,535,276 | A | 7/1996 | Ganesan | 380/25 |
| 5,541,927 | A | 7/1996 | Kristol et al. | 370/94.2 |
| 5,570,291 | A | 10/1996 | Dudle et al. | 364/468.01 |
| 5,598,536 | A | 1/1997 | Slaughter, III et al. | 395/200.16 |
| 5,608,900 | A | 3/1997 | Dockter et al. | 395/613 |
| 5,613,012 | A | 3/1997 | Hoffman et al. | 382/115 |
| 5,640,193 | A | 6/1997 | Wellner | 348/7 |
| 5,708,798 | A | 1/1998 | Lynch et al. | 395/500 |
| 5,745,568 | A | 4/1998 | O'Connor et al. | 380/4 |
| 5,764,886 | A | 6/1998 | Danielson et al. | 395/184.01 |
| 5,815,657 | A | 9/1998 | Williams et al. | 395/186 |
| 5,844,554 | A | 12/1998 | Geller et al. | 345/333 |
| 5,894,571 | A | 4/1999 | O'Connor | 395/652 |
| 5,915,093 | A | 6/1999 | Berlin et al. | 395/200.49 |
| 5,957,695 | A | 9/1999 | Redford et al. | 434/307 |
| 5,991,399 | A | 11/1999 | Graunke et al. | 380/4 |
| 5,991,543 | A | 11/1999 | Amberg et al. | 395/712 |
| 5,995,757 | A | 11/1999 | Amberg et al. | 395/712 |
| 6,003,012 | A | 12/1999 | Nick | 705/10 |
| 6,005,939 | A | 12/1999 | Fortenberry et al. | 380/21 |
| 6,009,406 | A | 12/1999 | Nick | 705/10 |

(Continued)

FOREIGN PATENT DOCUMENTS

EP 0685768 A1 6/1995

(Continued)

*Primary Examiner*—Sandra L Brase
(74) *Attorney, Agent, or Firm*—Hamilton & Terrile, LLP; Stephen A. Terrile

(57) ABSTRACT

A system for enabling ordering of printer supplies directly via a printer. The system provides an option for a user to request value bundled information before placing a printer supply order. By providing the option of requesting value bundled information, a customer can obtain information about printer supply promotions directly via the printer without the need for an information handling system to be coupled to the printer. Additionally, the system provides an encouragement to a customer to purchase a plurality of printer suppliers by providing the customer with incentives for the purchase.

15 Claims, 7 Drawing Sheets

U.S. PATENT DOCUMENTS

| | | | | |
|---|---|---|---|---|
| 6,012,100 | A | 1/2000 | Frailong et al. | 709/250 |
| 6,167,383 | A | 12/2000 | Henson | 705/26 |
| 6,182,275 | B1 | 1/2001 | Beelitz et al. | 717/1 |
| 6,236,901 | B1 | 5/2001 | Goss | 700/95 |
| 6,247,128 | B1 | 6/2001 | Fisher et al. | 713/100 |
| 6,295,423 | B1 | 9/2001 | Haines et al. | 399/24 |
| 6,327,706 | B1 | 12/2001 | Amberg et al. | 717/11 |
| 6,356,874 | B1 | 3/2002 | Øhrn | 705/6 |
| 6,385,623 | B1 | 5/2002 | Smith et al. | 707/200 |
| 6,385,766 | B1 | 5/2002 | Doran, Jr. et al. | 717/11 |
| 6,389,403 | B1 | 5/2002 | Dorak, Jr. | 705/52 |
| 6,393,539 | B1 | 5/2002 | Nguyen et al. | 711/164 |
| 6,418,555 | B2 | 7/2002 | Mohammed | 717/169 |
| 6,425,078 | B1 | 7/2002 | Smith et al. | 713/1 |
| 6,427,091 | B1 | 7/2002 | Davis et al. | 700/115 |
| 6,431,704 | B1 | 8/2002 | Silverbrook | 347/104 |
| 6,442,508 | B1 | 8/2002 | Liao et al. | 702/186 |
| 6,714,744 | B2 * | 3/2004 | Arima | 399/24 X |
| 6,798,997 | B1 * | 9/2004 | Hayward et al. | 399/24 X |
| 6,985,241 | B1 * | 1/2006 | Haines et al. | 399/24 X |
| 6,985,877 | B1 * | 1/2006 | Hayward et al. | 399/24 X |
| 7,085,505 | B2 * | 8/2006 | Itaya | 399/24 |
| 7,124,097 | B2 | 10/2006 | Claremont et al. | 705/26 |
| 2002/0073148 | A1 | 6/2002 | Haines et al. | 709/204 |
| 2002/0108439 | A1 | 8/2002 | Whitehead | 73/290 |
| 2002/0118243 | A1 | 8/2002 | Forman | 347/19 |
| 2004/0111326 | A1 | 6/2004 | Rock, Jr. et al. | 705/26 |

FOREIGN PATENT DOCUMENTS

| | | | |
|---|---|---|---|
| EP | 0843229 | A2 | 5/1998 |
| EP | 0921487 | A1 | 9/1999 |
| EP | 1085441 | A1 | 9/2000 |
| FR | 2 793 443 | | 5/1999 |
| GB | 2 371 129 | | 7/2002 |
| GB | 2 373 351 | | 8/2002 |
| JP | 2000-194767 | | 7/2000 |

* cited by examiner

PRINTER CONSUMABLE ORDERING DIRECT FROM PRINTER

BACKGROUND OF THE INVENTION

1. Field of the Invention

The present invention relates to printers, and more particularly to ordering printer consumables directly via a printer.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems. Known printers are another example of an information handling system.

Many business and individuals need to print documents. In fact, the ability to print documents can be a critical requirement in many cases. Accordingly, printer owners place a high value on the functionality of their printers. Some businesses may own and operate a large number of printers. One challenge that can be encountered is ensuring that printers are available when needed. This involves ensuring that replacements to printer consumables are available when the printer consumable within the printer is depleted.

Additionally, some printer companies provide printers and printer consumables to customers via the mail and may not have a retail storefront presence. A consumer may ignore the automatic warning of "low ink" levels when generated. When the ink finally runs out, they can only order on-line and at best with next day delivery. With this type of supply chain, it becomes important to provide a printer customer with the forewarning of the need to replace a printer consumable before the consumable is depleted. If a customer waits until the printer consumable is already depleted, then the printer customer would be unable to use their printer until receiving a replacement consumable in the mail. The option of just running down to the store is not available.

With printer companies that remotely provide printer consumables, the printer consumables are generally ordered either via telephone or via the Internet, often using an information handling system that is coupled to the printer. It is known to provide software which facilitates the ordering of printer consumables. This software is often loaded onto an information handling system when the printer is coupled to the information handling system. This software works well for printers that are installed in a consumer segment; however, issues can arise for printers that are installed in a business environment. This method of replenishing printer consumables depends on software application. Often with printers that are installed in a business environment, a small installed foot print is desired. Thus, in many business environment printer installations, only the print driver is installed without the installation of additional software. Without installing this additional software, when ordering printer consumables it is often necessary to determine a unique identifier of the printer (e.g., a service tag), where to order the printer consumables and the telephone number, physical address or web address to use to access the provider so that the consumables can be replenished.

Accordingly, it is desirable to provide an ability to order printer supplies that does not require the use of software installed on information handling systems coupled to the printer.

SUMMARY OF THE INVENTION

In accordance with the present invention, a system for enabling ordering of printer supplies directly via the printer is set forth. In certain embodiments, the system provides an option for a user to request value bundled information before placing a printer supply order. By providing the option of requesting value bundled information, a customer can obtain information about printer supply promotions directly via the printer without the need for an information handling system to be coupled to the printer. Additionally, the system provides an encouragement to a customer to purchase a plurality of printer suppliers by providing the customer with incentives for the purchase.

More specifically, in one embodiment, the invention relates to a method for ordering printer consumables directly from a printer. The printer comprises a display and a control system. The method includes determining when a printer consumable is close to depletion, informing a user that the printer consumable is close to depletion via the display based upon the determination, and ordering a replacement to the printer consumable from a printer consumables supplier directly from the printer via the control system.

In another embodiment, the invention relates to an apparatus for ordering printer consumables directly from a printer. The printer comprises a display and a control system. The apparatus includes means for determining when a printer consumable is close to depletion, means for informing a user that the printer consumable is close to depletion via the display based upon the determination, and means for ordering a replacement to the printer consumable from a printer consumables supplier directly from the printer via the control system.

In another embodiment, the invention relates to a printer which includes a control system, a display coupled to the control system and a system for ordering printer consumables directly from the printer. The system comprises instructions executable by the control system for determining when a printer consumable is close to depletion, informing a user that the printer consumable is close to depletion via the display based upon the determination, and ordering a replacement to the printer consumable from the printer consumables supplier directly from the printer via the control system.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
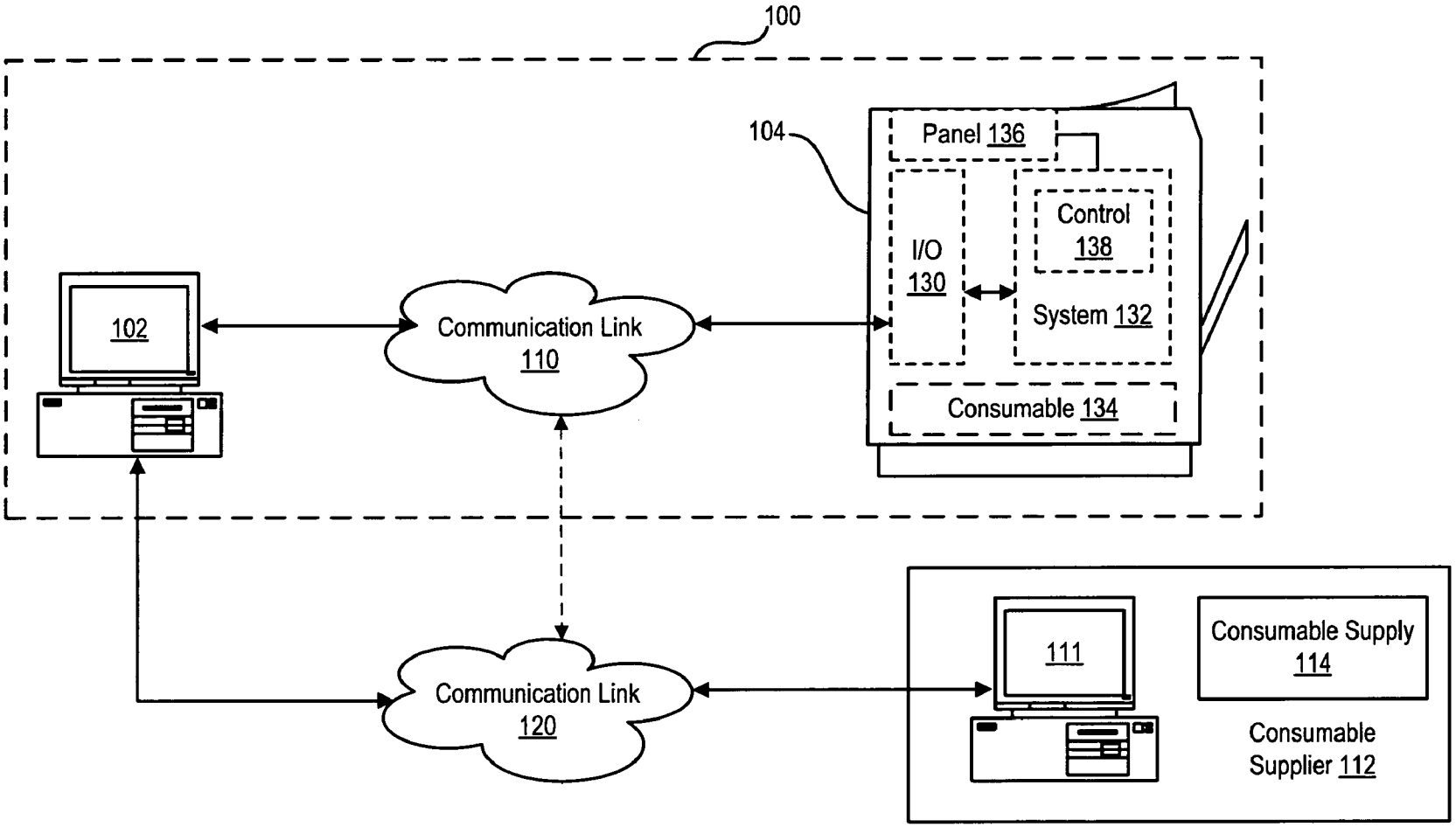
FIG. 1 shows a block diagram of an environment in which a printer is used.

Referring to FIG. 1, a block diagram of an environment in which a printer is used is shown. The environment includes a computer system 102 and a printer 104, coupled via a communication link 110. The communication link 110 might be a printer cable, a network connection or any other link which information is communicated with the printer 104.

The computer system 102 is also connected to another computer system (e.g., a vendor computer system) 111 via a second communication link 120. The second communication link 120 may be a telephone system or some other type of network, such as the Internet. In one embodiment, computer system 111 is owned and operated by a printer consumable supplier 112. In this example, the printer consumable supplier 112 provides printer consumables for use with the printer 104 from a supply 114 of printer consumables. The printer 104 may be directly coupled to the second communication link 120, in which case communication may occur between the printer and anything coupled to the second communication link 120.

The printer 104 includes an input output (I/O) port 130, a control system 132 and at least one printer consumable 134. The I/O port 130 facilitates communications between the printer 104 and other devices connected to the communications link 110. The control system 132 provides the printer 104 with certain control functionality. The control system 132 includes a processor and memory coupled to the processor. The print consumables ordering system may be stored on either the memory of the printer.

The printer consumable 134 represents any component in the printer 104 that is subject to depletion through use of the printer 104. For example, the printer consumable 134 may be a toner cartridge or an inkjet cartridge, etc. The printer consumable supplier maintains a supply 114 of replacement printer consumables 134.

The computer system 102 generates a document in an electronic form and transmits the document (in the form of a print job) to the printer 104. The printer 104 receives the print job via the I/O port 130 and prints the document. Each time the printer 104 prints a document, the printer 104 transmits a pre-defined message to the computer 102.

It may be determined that the consumable 134 should be replaced when certain criteria are met. For example, it is assumed that the consumable 134 should be replaced each time the printer 104 prints "n" pages with the assistance of an ink drop count or a sensor on the cartridge. When this event occurs, the control system 132 sets a consumable replacement indicator.

The status of the consumable replacement indicator may be determined by the computer 102. This is accomplished by the computer 102 transmitting a pre-defined query to the printer 104. The printer 104 responds to the query by generating a response indicating whether the consumable replacement indicator is set.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 2:
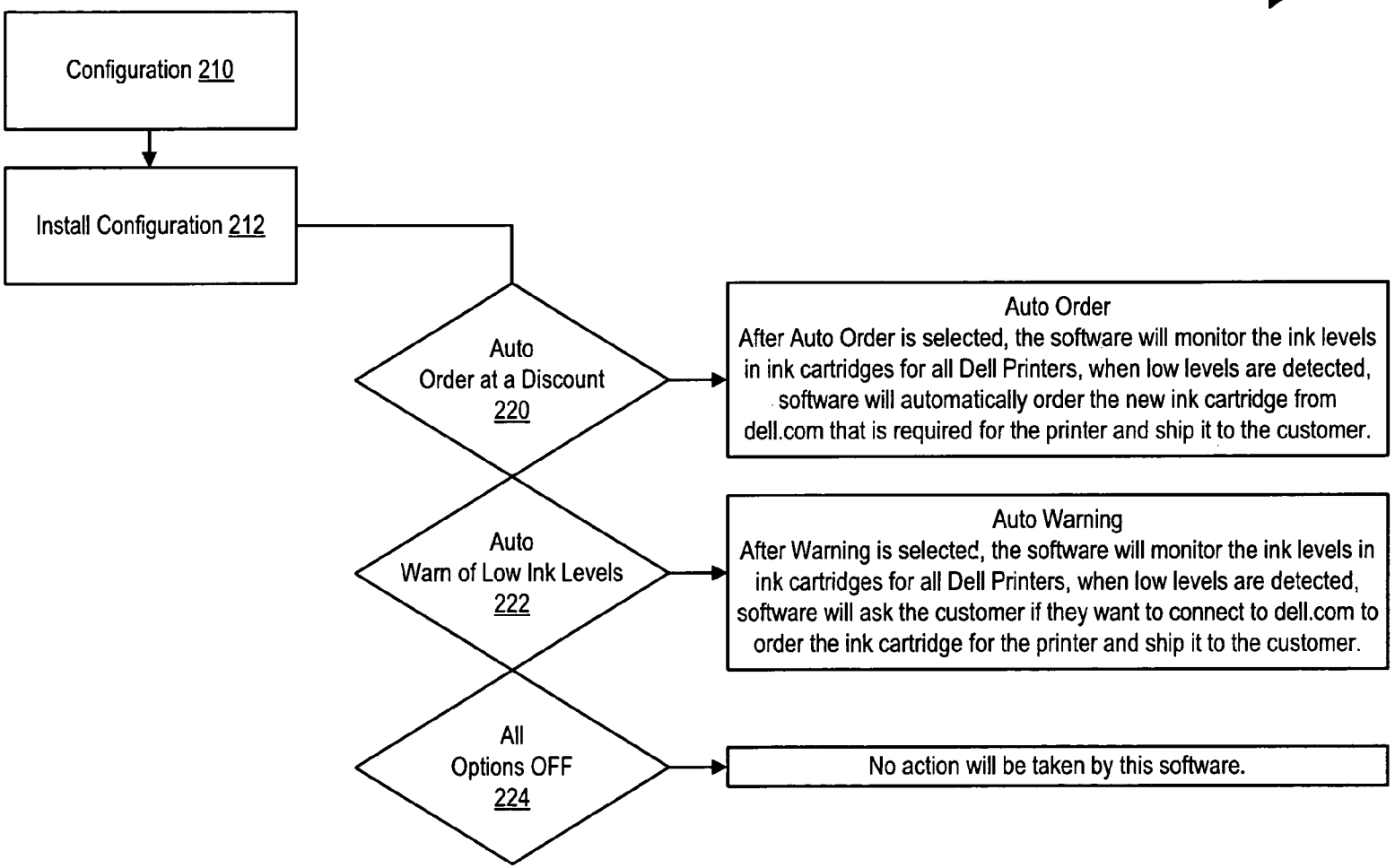
FIG. 2 shows a flow chart of the operation of a print cartridge ordering system.

Referring to FIG. 2, the print cartridge reordering system 200 includes a plurality of user selectable options. For example, these options can include whether to enable automatic reorder of print consumables and whether to automatically warn of low ink levels, or whether to disable all options within the printer.

In operation, when a customer is ordering a printer, the customer may configure a plurality of options at step 210. The options can include an automatic order at discount option, an automatic warning of low ink levels, and an all options off option. During a factory installation operation, the printer is configured at the factory to reflect the options selected by the customer at step 210. Additionally, the configuration may be performed by a user via a software application.

More specifically, an automatic order at discount option may be configured at step 220. An automatic warning of low ink levels may be configured at step 222, or an all options off option may be configured at step 224. When the automatic order at discount option is selected, firmware within the printer 104 monitors ink levels within the printer consumable. When a low level is detected, the software automatically orders a new ink cartridge from the printer supplier. The supplier receives the order and ships the replacement cartridge to the printer owner.

When the automatic warning option is selected, software within the printer 104 monitors ink levels of the ink cartridges. When a low level is detected, the software queries the printer customer if they want to connect to the printer supplier web site to order a replacement cartridge. The printer includes controls on the panel 136 to so inform the customer and to facilitate ordering of the printer consumables. If so, then the customer is automatically directly connected to the printer supplier web site, and when the printer supplier receives the order, it ships the replacement cartridge to the customer. When the all options off option is selected, then no action is taken by the software within the printer 104.

Figure 3:
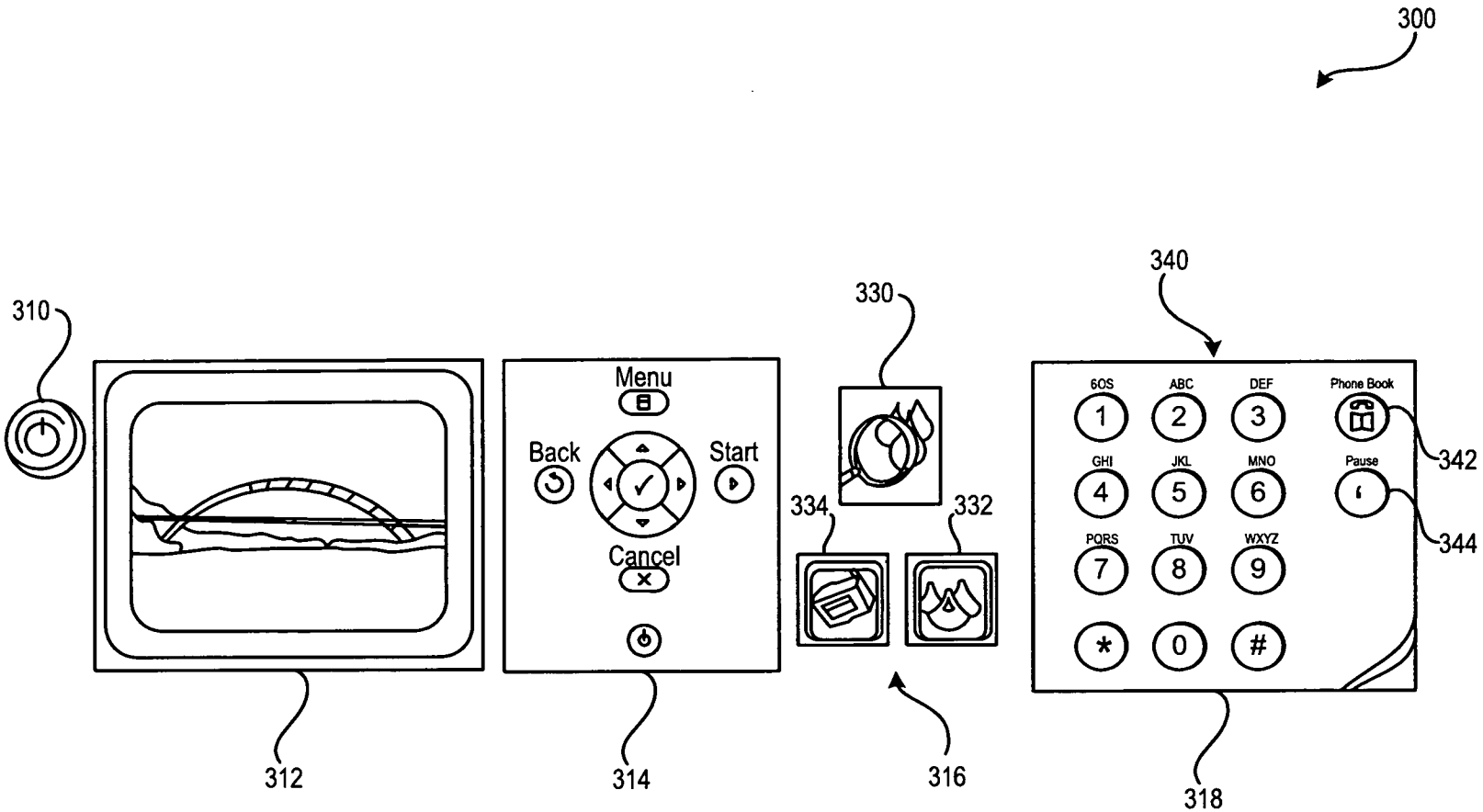
FIG. 3 shows a diagrammatic representation of a printer control panel.

Referring to FIG. 3, diagrammatic representation of a printer control panel is shown. More specifically, the printer control panel includes a power button 310, a screen portion 312, a control portion 314, a consumables control portion 316 and a numeric portion 318. The screen portion 312 includes a display for presenting information (e.g., an LCD display).

The control portion 314 includes navigation buttons for controlling various features of the printer.

The consumables control portion includes a plurality of consumables indicia, including an ink level indicia 330, a supplies promotion indicia 332 and a supply ordering indicia 334. Actuating the ink level indicia 330 causes printer consumable levels such as ink levels, to be presented on the display. Actuating the supplies promotion indicia 332 causes promotional information to be retrieved from a consumables supplier and to present the promotional information on the display. Actuating the supplies ordering indicia allows a user to place a consumables order directly from the printer. The plurality of consumables indicia are controlled via firmware that is stored on the memory of the control system 132. When a consumables indicia is actuated, the control system 132 guides a user to complete direct ordering from the printer via presentations on the display and a hard copy of the order is printed via the printer with the relevant order details.

The numeric portion 318 includes buttons for various numeric and alphanumeric inputs 340 as well as telephonic control buttons 342, 344.

The system for enabling ordering of printer supplies directly via a printer provides a plurality of advantages. For example, the system for enabling ordering of printer supplies directly via a printer provides an ordering mechanism to enhance the current solution by extending a direct supplies order application from printer. For an unmanaged networking environment, this solution provides a user friendly method for ordering printer consumables. Additionally, this system for enabling ordering of printer supplies directly via a printer provides another method for customers to order printer consumables whether or not software is installed on an information handing system that is coupled to the printer, especially because powering up a printer usually occupies less time than powering up a computer. Additionally, this system for enabling ordering of printer supplies directly via a printer provides a simplified method to order correct printer consumables as the service tag is always attached with the printer.

Figure 4:
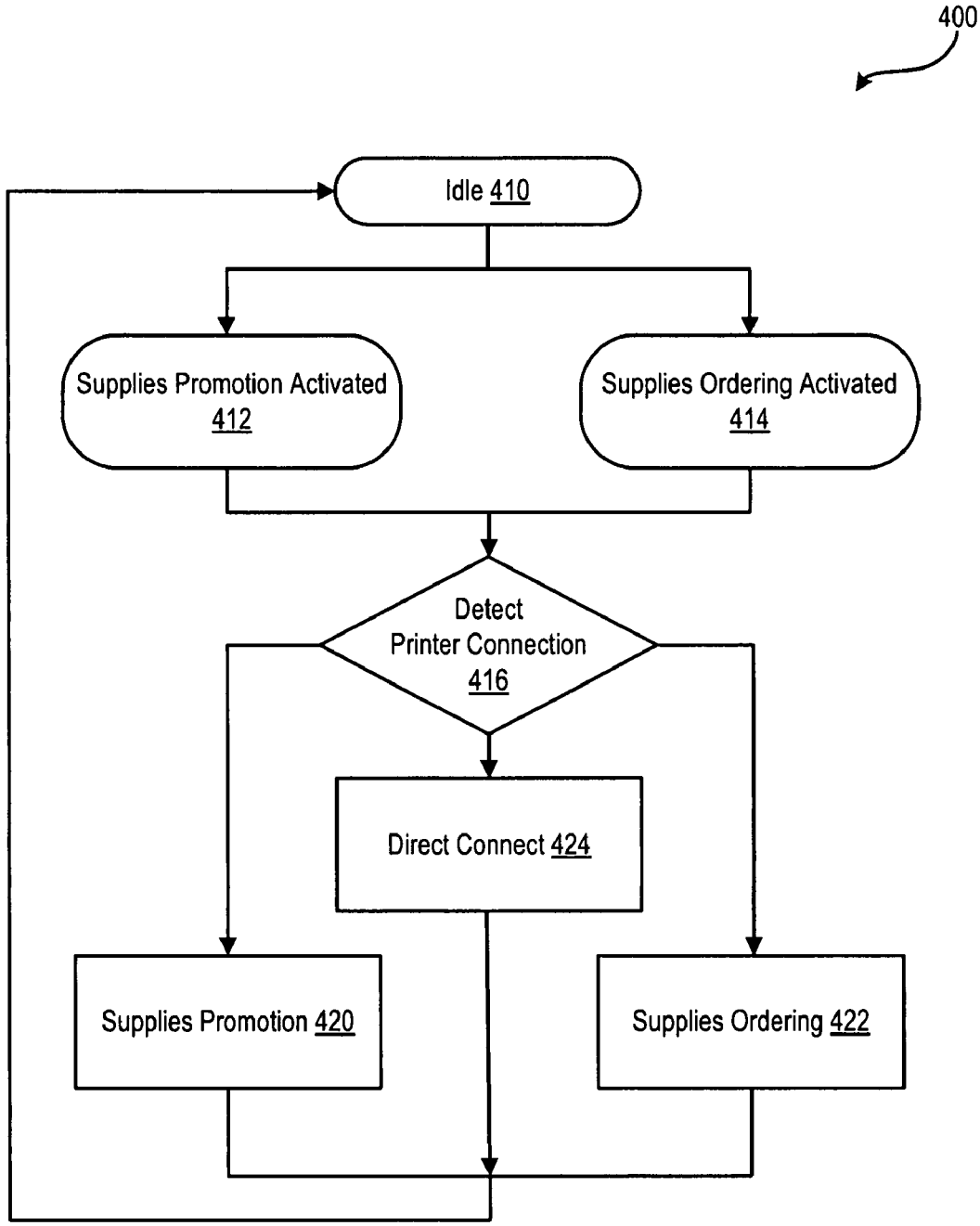
FIG. 4 shows a flow chart of the operation of a system for enabling ordering of printer supplies directly via a printer.

Referring to FIG. 4, a flow chart of the operation of a system 400 for enabling ordering of printer supplies directly via a printer is shown. The system 400 may be instantiated in firmware stored within the control system 132 of the printer 104. The system for enabling ordering of printer supplies 400 remains in an idle state at step 410 until a reorder option is actuated. The reorder options can include a supplies bundle option or a suppliers order option. For example, if the supplies promotion button is actuated at step 412 (or a supplies promotion option is selected via a menu presented on the display using the navigation portion 314), or if the supplies ordering button is actuated at step 414 (or a supplies ordering option is selected via a menu presented on the display using the navigation portion 314), then the system 400 determines whether a network connection or direct connect printer connection is present at step 416. The result of the connection determination dictates which operation is performed next by the system 400. More specifically, if the system 400 determines that the printer is network connected and the supplies promotion option was selected, then the system proceeds to a supplies promotion operation 420. If the system 400 determines that the printer is network connected and the supplies ordering option was selected, then the system proceeds to a supplies promotion operation 422. If the system 400 determines that the printer is direct connected then the system proceeds to a direct connect operation 424. After any of the supplies promotion operation 420, supplies promotion operation 422, or direct connect operation 424 complete, the system returns to the idle state 410.

Figure 5:
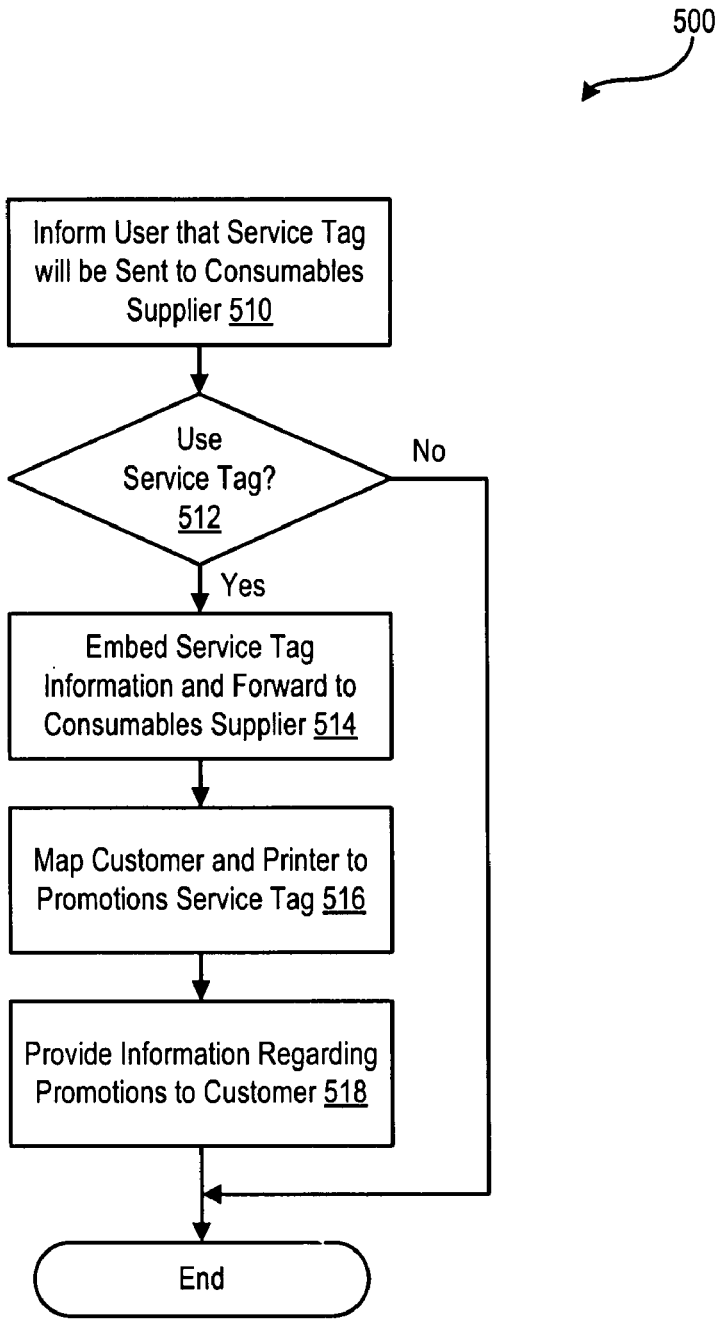
FIG. 5 shows a flow chart of the operation of a supplies promotion operation.

Referring to FIG. 5, a flow chart of the supplies promotion operation 420 is shown. More specifically, when the network connection is present and a suppliers ordering operation is selected, the system 400 informs the user that the service tag of the printer 104 will be provided to the consumables supplier to provide information regarding supply promotions at step 510. The system 400 then prompts the user regarding whether permission is granted to provide the service tag at step 512. If the user does not grant permission, then the supplier promotion operation ends.

If the user grants permission to provide the service tag to the consumables supplier, then service tag information is embedded into a package that is provided to the consumables supplier at step 514. The consumables supplier than uses this printer service tag information to map the customer and the printer model to any available promotions or supplies bundles at step 516. This promotion information is provided to the customer at step 518 and the supplier promotion operation completes.

Figure 6:
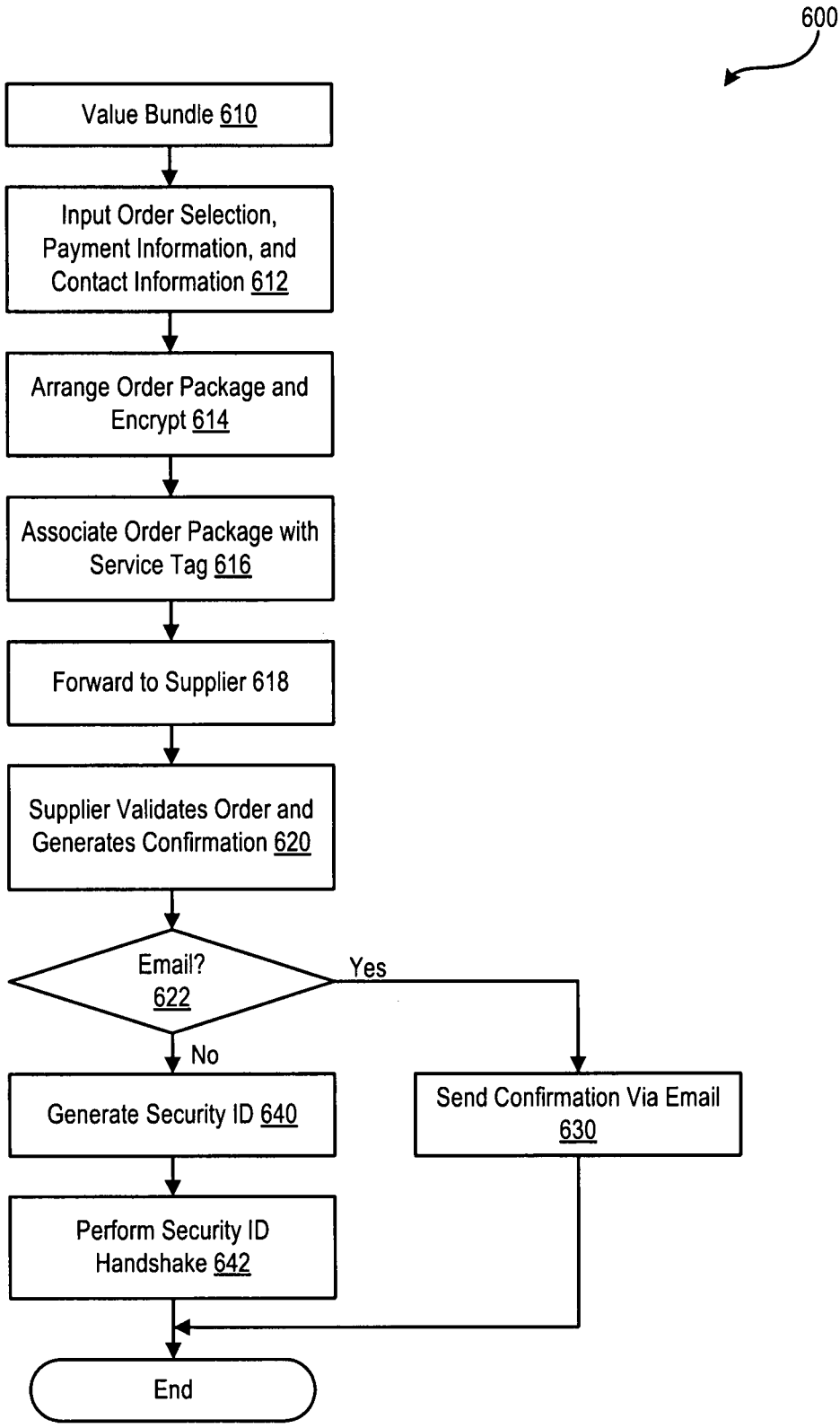
FIG. 6 shows a flow chart of the operation of a supplies order operation.

Referring to FIG. 6, a flow chart of the supplies order operation 422 is shown. More specifically, when the network connection is present and a suppliers ordering operation is selected, the system 400 prompts the user regarding whether value bundle supply information has been obtained at step 610. Next, at step 612, the system 400 prompts the user to input an order selection to provide payment information such as a credit card number and an expiration date and to provide contact information such as an email address. This information may be directly entered via the menu portion 314 and the keypad portion 318 of the printer 104. The system can also provide an option of saving the information within the printer so that the entered information can be easily recalled on future orders. The information is arranged as an order package and is encrypted at step 614.

The order package is then associated with the service tag corresponding to the printer 104 at step 616 and sent to a printer consumables supplier at step 618 along with the service tag of the printer from which the order is being generated. Next the printer consumables supplier validates the order and generates an order confirmation message at step 620. This confirmation message can include a message that is provided to the printer as a print job. Thus, the printer can directly and automatically print a confirmation of the order.

Next, the printer consumables supplier determines whether the user provided an email within the entered contact information at step 622. If the customer did provide an email address, then the printer consumables supplier provides a confirmation email (including for example, a purchase order) to the customer. After the confirmation email is generated, the supplies order operation completes.

If the customer did not provide an email, then the printer consumables supplier generates a security identifier (e.g., a security personal identification number (PIN)) at step 640. The printer consumables supplier then performs a handshake operation with the printer to confirm the authenticity of the order at step 642. The handshake operation can include requesting that the customer reenter the security identifier at the printer 104 and that this security identifier is provided to the printer consumables supplier via the printer 104. After the authenticity of the order is confirmed, the supplies order operation completes.

Figure 7:
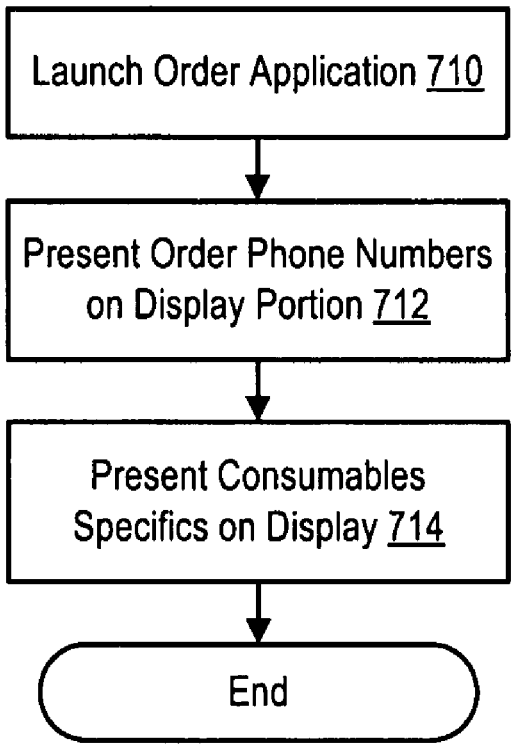
FIG. 7 shows a flow chart of a direct connect operation.

Referring to FIG. 7, a flow chart of the direct connect operation 424 is shown. More specifically, when the network connection is not present then the system launches a direct connect order application at step 710. The direct connect order application is stored within the memory of the control system 132 and is executed by the processor of the control system 132. The order application presents consumables supplier contact information (such as order telephone numbers, physical addresses or website addresses) at step 712 via the display 312 to facilitate the customer's ordering of printer consumables. After the contact information is presented, the direct connect order application presents consumables information that is specific to the printer 104 via the display 312 at step 714. The consumables information can include part identifiers for the printer consumables as well as the service tag of the printer 104.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

For example, the ordering features can be locked by authorized personal via e.g., an embedded application such as an embedded web server application. The ordering features can thus be password protected.

For example, the above-discussed embodiments include software modules that perform certain tasks. The software modules discussed herein may include script, batch, or other executable files. The software modules may be stored on a machine-readable or computer-readable storage medium such as a disk drive. Storage devices used for storing software modules in accordance with an embodiment of the invention may be magnetic floppy disks, hard disks, or optical discs such as CD-ROMs or CD-Rs, for example. A storage device used for storing firmware or hardware modules in accordance with an embodiment of the invention may also include a semiconductor-based memory, which may be permanently, removably or remotely coupled to a microprocessor/memory system. Thus, the modules may be stored within a computer system memory to configure the computer system to perform the functions of the module. Other new and various types of computer-readable storage media may be used to store the modules discussed herein. Additionally, those skilled in the art will recognize that the separation of functionality into modules is for illustrative purposes. Alternative embodiments may merge the functionality of multiple modules into a single module or may impose an alternate decomposition of functionality of modules. For example, a software module for calling sub-modules may be decomposed so that each sub-module performs its function and passes control directly to another sub-module.

Consequently, the invention is intended to be limited only by the spirit and scope of the appended claims, giving full cognizance to equivalents in all respects.

What is claimed is:

1. A method for ordering printer consumables directly from a printer, the printer comprising a display and a control system, the method comprising:

determining when a printer consumable is close to depletion;

informing a user that the printer consumable is close to depletion via the display based upon the determining; and, ordering a replacement to the printer consumable from a printer consumables supplier directly from the printer via the control system; and wherein the ordering comprises automatically providing the printer consumables supplier with a unique identifier of the printer; and , the replacement to the printer consumable is based upon the unique identifier of the printer.

2. The method of claim 1 wherein:

the ordering comprises determining whether the printer is coupled to a network connection capable of communicating via the Internet.

3. The method of claim 1 wherein:

when a network connection is present, communicating with the printer consumables supplier directly via the printer.

4. The method of claim 1 wherein:

when a network connection is present, automatically communicating with the printer consumables supplier to determine whether any consumables promotions are available for the printer.

5. The method of claim 1 further comprising:

the unique identifier comprises a printer service tag.

6. An apparatus for ordering printer consumables directly from a printer, the printer comprising a display and a control system, the method comprising:

means for determining when a printer consumable is close to depletion;

means for informing a user that the printer consumable is close to depletion via the display based upon the determining; and, means for ordering a replacement to the printer consumable from a printer consumables supplier directly from the printer via the control system; and wherein the ordering comprises automatically providing the printer consumables supplier with a unique identifier of the printer; and, the replacement to the printer consumable is based upon the unique identifier of the printer.

7. The apparatus of claim 6 wherein:

the ordering comprises determining whether the printer is coupled to a network connection capable of communicating via the Internet.

8. The apparatus of claim 6 wherein:

when a network connection is present, communicating with the printer consumables supplier directly via the printer.

9. The apparatus of claim 8 wherein:

the unique identifier comprises a printer service tag.

10. The apparatus of claim 6 wherein:

when a network connection is present, automatically communicating with the printer consumables supplier to determine whether any consumables promotions are available for the printer.

11. A printer comprising:

a control system;

a display coupled to the control system;

a system for ordering printer consumables directly from the printer, the system comprising instructions executable by the control system for:

determining when a printer consumable is close to depletion;

informing a user that the printer consumable is close to depletion via the display based upon the determining; and, ordering a replacement to the printer consumable from the printer consumables supplier directly from the printer via the control system; and wherein the ordering comprises automatically providing the printer consumables supplier with a unique identifier of the printer; and, the replacement to the printer consumable is based upon the unique identifier of the printer.

12. The printer of claim 11 wherein the system for ordering printer consumables directly from the printer further comprises the instructions executable by the control system for:

determining whether the printer is coupled to a network connection capable of communicating via the Internet.

13. The printer of claim 12 wherein the system for ordering printer consumables directly from the printer further comprises the instructions executable by the control system for:

communicating with the printer consumables supplier directly via the printer when a network connection is present.

14. The printer of claim 12 wherein the system for ordering printer consumables directly from the printer further comprises the instructions executable by the control system for:

automatically communicating with the printer consumables supplier to determine whether any consumables promotions are available for the printer when a network connection is present.

15. The printer of claim 11 wherein:

the unique identifier comprises a printer service tag.

* * * * *